US006357859B1

(12) United States Patent
Klees

(10) Patent No.: US 6,357,859 B1
(45) **Date of Patent: *Mar. 19, 2002**

(54) PRINTER AND METHOD WITH AN ELECTROMAGNETIC-INHIBITING OPTICAL DATA LINK TRANSMITTING IMAGE FORMING DATA

(75) Inventor: Kevin J. Klees, Rochester, NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/936,061

(22) Filed: Sep. 23, 1997

(51) Int. Cl.[7] ..... B41J 2/14; B41J 2/16

(52) U.S. Cl. ..... 347/50

(58) Field of Search ..... 347/50, 37, 20

(56) References Cited

U.S. PATENT DOCUMENTS

| | | | | |
|---|---|---|---|---|
| 4,837,589 A | | 6/1989 | Dodge | |
| 5,075,792 A | | 12/1991 | Brown et al. | |
| 5,152,624 A | * | 10/1992 | Buschmann et al. | 400/691 |
| 5,189,547 A | * | 2/1993 | Day et al. | 359/245 |
| 5,197,892 A | * | 3/1993 | Yoshizawa | 439/91 |
| 5,311,255 A | | 5/1994 | Josephson | |
| 5,321,426 A | | 6/1994 | Baek et al. | |
| 5,365,255 A | * | 11/1994 | Inoue et al. | 347/45 |
| 5,396,078 A | * | 3/1995 | Klaus et al. | 250/551 |
| 5,397,192 A | * | 3/1995 | Khormaee | 400/708 |
| 5,434,430 A | * | 7/1995 | Stewart | 250/573 |
| 5,453,145 A | * | 9/1995 | Beaman et al. | 156/230 |
| 5,553,997 A | * | 9/1996 | Goshaw et al. | 415/17 |
| 5,567,063 A | * | 10/1996 | Chiu | 400/174 |
| 5,627,577 A | * | 5/1997 | Buican | 347/50 |

FOREIGN PATENT DOCUMENTS

| | | |
|---|---|---|
| DE | 4119110 | 12/1992 |
| EP | 0642925 | 3/1995 |
| EP | 0644057 | 3/1995 |
| JP | 61213183 | 9/1986 |
| JP | 02198886 | 8/1990 |
| JP | 09116288 | 5/1997 |

OTHER PUBLICATIONS

Smith, Ralph J.; Circuits, Devices, and Systems; (N.Y., John Wiley & Sons, 1984), p. 497.*

Hewlett Packard Company, "IrDA Data Link Design Guide", On or Before Sep. 12, 1997, pp. 1–22.

* cited by examiner

*Primary Examiner*—John Barlow
*Assistant Examiner*—Michael S Brooke
(74) *Attorney, Agent, or Firm*—Walter S. Stevens; Norman Rushefsky

(57) ABSTRACT

Printer and method with an electromagnetic interference reducing optical data link for transmitting image forming data. The printer comprises a print head capable of being actuated to form the image on a receiver. A photodetector is connected to the print head for detecting image forming data carried by an infrared light beam. The photodetector also actuates the print head in response to the image forming data detected by the photodetector. Also provided is a light source in optical communication with the photodetector for emitting the light beam. The photodetector detects the image forming data as the light source emits the light beam and the print head is actuated as the photodetector detects the image forming data. The print head forms the image on the receiver in accordance with the image forming data as the print head is actuated. The printer apparatus also comprises a controller, which may be a computer, connected to the print head for supplying control data to the print head in order to control the print head.

13 Claims, 3 Drawing Sheets

PRINTER AND METHOD WITH AN ELECTROMAGNETIC-INHIBITING OPTICAL DATA LINK TRANSMITTING IMAGE FORMING DATA

FIELD OF THE INVENTION

This invention generally relates to printing apparatus and methods and more particularly relates to a printing apparatus and method including an electromagnetic interference reducing optical data link for transmitting image forming data.

BACKGROUND OF THE INVENTION

In the typical printer, a carriage carrying a print head translates linearly along one dimension of a receiver as the receiver is held momentarily stationary beneath the print head, whereupon the print head prints one or more lines of image data on the receiver. After one sweep of the carriage, the receiver is advanced a predetermined distance and another sweep is performed to print another line of image data on the receiver. By modulating the image data in synchronization with translation speed of the receiver, a complete raster image is eventually printed or exposed onto the receiver.

In such printers, an image control computer conventionally communicates with the print head by means of a flexible electrical cable with multiple conductor wires therein. The wires in the cable carry the image forming data from the computer to the print head. However, it is known that electromagnetic radiation and power supply noise are generated by the printer's components, such as electrical cabling, switched mode power supplies, direct current and alternating current converters, external monitor input and output devices, power ports, clock generators, electronic circuitry and computers. The electromagnetic radiation emitting from the cable in addition to the computer and any electronic circuitry present therein may interfere with proper operation of nearby electronic devices.

As stated hereinabove, the flexible cable interconnects the control computer to the print head in order to transmit image forming data between the computer and the print head. This results in a radio frequency electromagnetic field emitting from the flexible cable. As image resolutions and data bit depths increase, the frequency of data and clock signals that are transmitted along the cable also increase. In addition, as image widths increase, length of the flexible cable, and therefore electromagnetic radiation emissions, also increase. Moreover, as control computer clock frequencies increase, it becomes more difficult to limit these electromagnetic emissions to international regulatory standards, such as standards promulgated by the United States Government Federal Communications Commission (FCC), as well as national governments worldwide. Prior art solutions to the problems recited hereinabove have been to increase the number of conductors in the cable, to increase the cable shielding or even completely shield the printer. However, these solutions increase size, weight and cost of the printer.

A typical non-contact LED (Light Emitting Diode) array image printer is disclosed in U.S. Pat. No. 4,837,589 titled "Non-Contact LED-Array Image Printer" issued Jun. 6, 1989 in the name of Dennis W. Dodge. This patent discloses that an LED array is mounted on a substrate bearing an interface control circuit which receives video data through a ribbon cable. The LED array is imaged by a lens onto an exposure plane on a platen parallel to the direction of scanning. A photosensitive medium is driven in registration in forward and reverse directions biased against the exposure platen which defines the image plane. However, the device disclosed by this patent still uses a ribbon cable to transmit video data to the control circuit. Thus, this patent does not disclose a suitable solution to the problem of electromagnetic radiation caused by transmission of the video data to the control circuit.

Therefore, there has been a long-felt need to provide an apparatus and method including an electromagnetic interference reduction technique for transmitting image forming data.

SUMMARY OF THE INVENTION

The invention resides in a printer apparatus having an electromagnetic interference reducing optical data link transmitting image forming data. The printer comprises a print head capable of being actuated to form the image on a receiver. More specifically, a photodetector is connected to the print head for detecting image forming data carried by an infrared light beam. The photodetector also actuates the print head in response to the image forming data detected by the photodetector in order to print the image on the receiver. In addition, also provided is a light source in optical communication with the photodetector for emitting the light beam to be received by the photodetector. In this manner, the photodetector detects the image forming data as the light source emits the light beam and the print head is actuated with this image forming data. The print head forms the image on the receiver in accordance with the image forming data. In this manner, image forming data is transmitted from the light source to the print head by means of the light beam, thereby removing high frequency electronic signals from any interconnecting flexible multiconductor electrical cable which would otherwise emit undesirable high frequency electromagnetic radiation harmful to operation of any nearby electronic devices.

The printer apparatus also comprises a controller, which may be a computer, connected to a carriage carrying the print head for supplying control data to the carriage in order to control movement of the carriage. Such a controller emits a first electromagnetic field. In order to ameliorate the first electromagnetic field, a first shielding enclosure surrounds the controller and thereby shields against the first electromagnetic field. A carriage is connected to the print head for carrying the print head relative to the receiver. The carriage includes electronic circuitry therein for electrically actuating the print head in response to the image forming data detected by the photodetector. Such electronic circuitry emits a second electromagnetic field. In order to ameliorate the second electromagnetic field, a second shielding enclosure surrounds the carriage and associated electronic circuitry and thereby shields against the second electromagnetic field. The previously mentioned flexible multiconductor electronic cable is provided to transfer low frequency electronic signals between the controller and the carriage. Since only low frequency electronic signals are transmitted via this cable, it is easier to reduce electromagnetic emissions to comply with the aforementioned Governmental limits. Thus, other electronic devices which may be in the vicinity of the printer are shielded from electromagnetic radiation emitting from the controller and electronic circuitry in the carriage.

A support member, which may be a platen, is disposed near the print head for supporting the receiver at a position adjacent the print head. A translation member, which may be a roller, is disposed adjacent the support member, the translation member being capable of intimately engaging the receiver for translating the receiver through a nip defined between the print head and the support member. Also provided is a first motor engaging the roller for rotating the roller, so that the receiver translates through the nip as the first motor rotates the roller. In addition, a rotatable lead screw threadably engages the carriage for translating the carriage along the lead screw. A second motor rotates the lead screw, so that the carriage translates along the lead screw as the lead screw rotates.

An object of the present invention is to provide a printing apparatus and method including an electromagnetic interference reducing optical data link for transmitting image forming data to a print head included in the printing apparatus.

A feature of the present invention is the provision of a light source emitting an infrared light beam carrying high frequency image forming data detectable by a photodetector connected to the print head but spaced-apart from the light source, which photodetector converts the image forming data into electrical pulses by means of electrical circuitry which in turn controls printing on the receiver by the print head that is connected to the photodetector.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
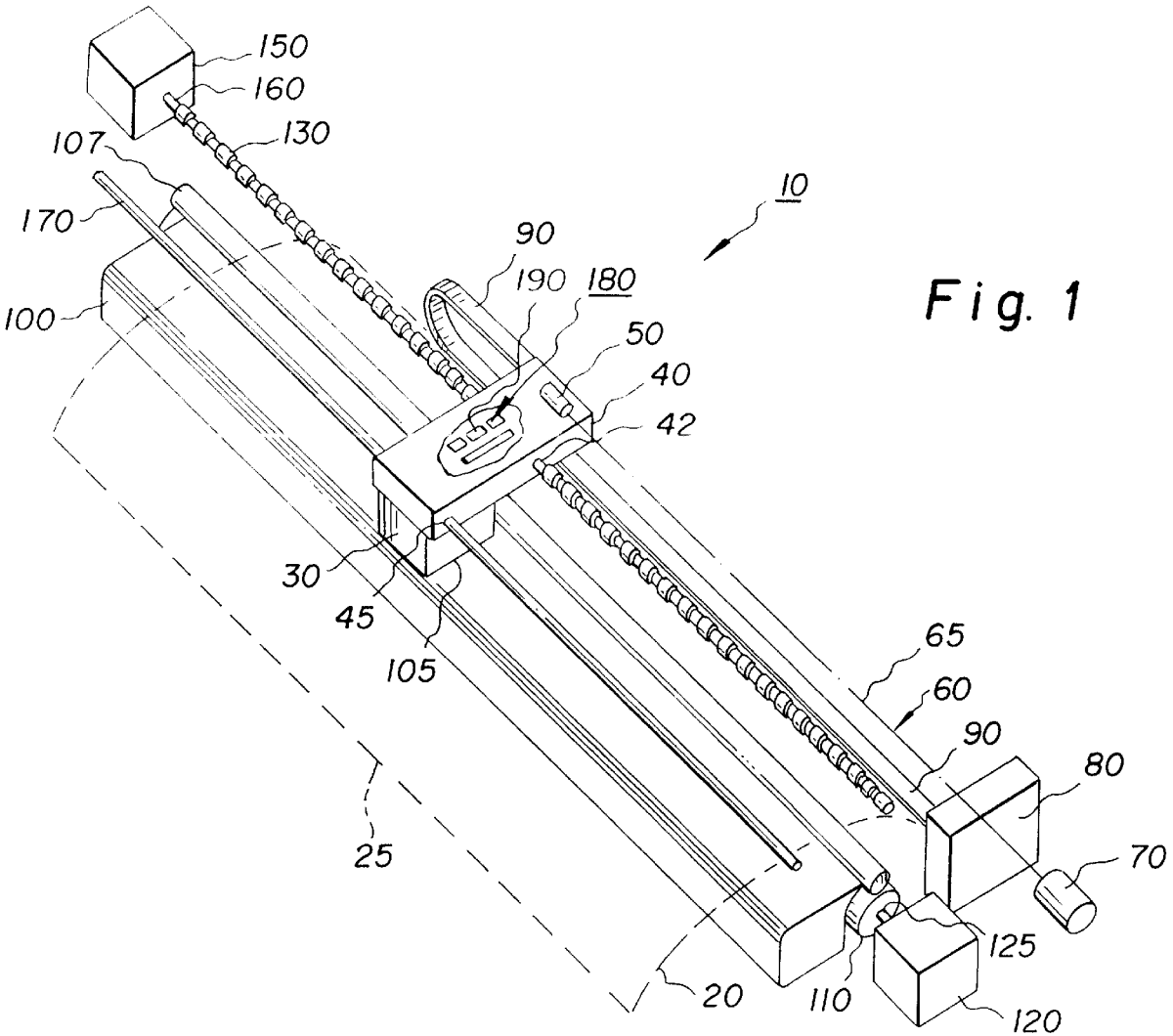
FIG. 1 is a view in perspective of a printer apparatus with parts removed for clarity.
Figure 2:
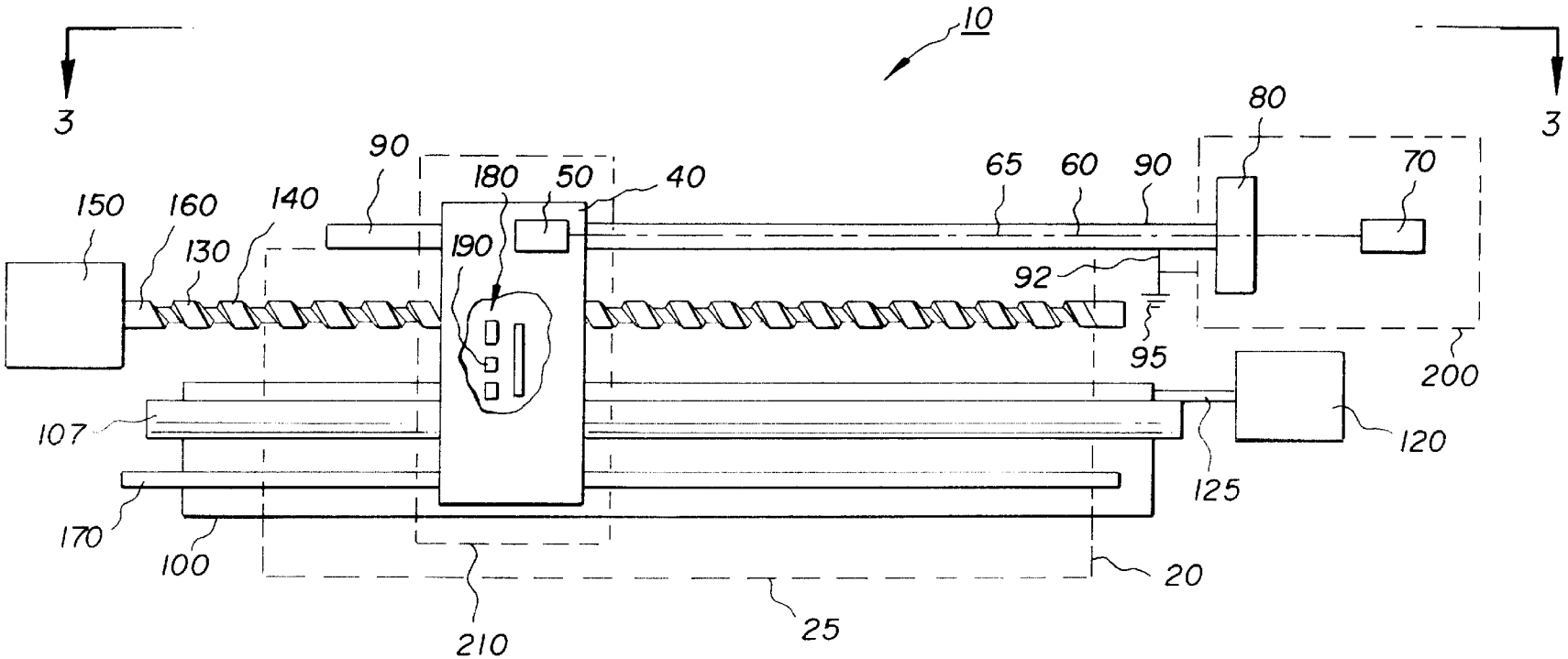
FIG. 2 is a plan view of the printer apparatus.
Figure 3:
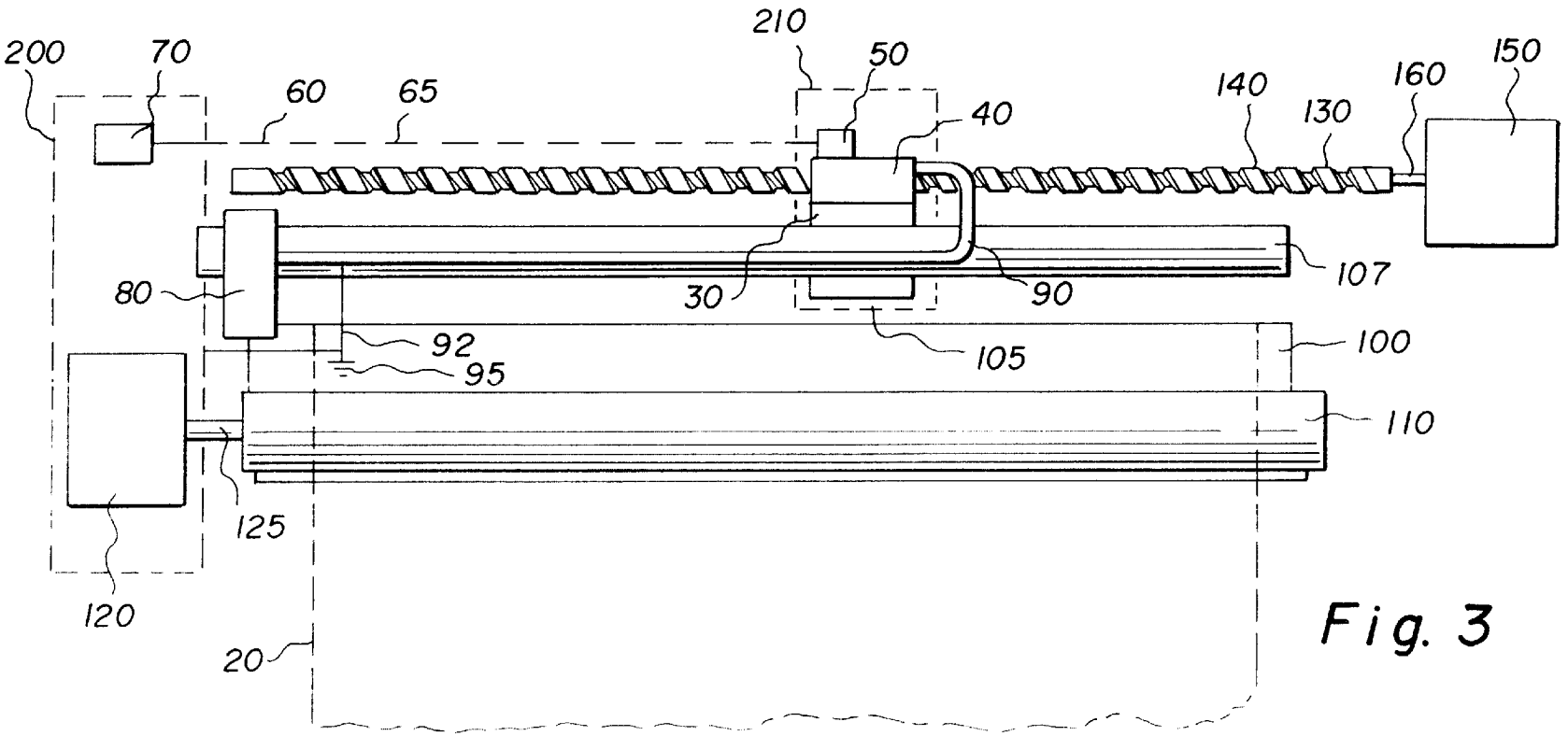
FIG. 3 is a view in elevation of the printer apparatus taken along section line 3—3 of FIG. 2.

Therefore, referring to FIGS. 1, 2 and 3, there is shown a printer apparatus, generally referred to as 10, with an electromagnetic interference reducing optical data link for transmitting image forming data so as to form an image on a receiver 20. In this regard, receiver 20, which has a marginal edge 25, may be paper or transparency. Printer 10 comprises a print head 30, which is capable of being actuated to form the image on receiver 20. In this regard, print head 30 may be any suitable print head, such as an electrostatic, inkjet or LED (Light Emitting Diode) print head. Print head 30 is attached to a carriage 40 for carrying print head 30 relative to receiver 20. As described more fully hereinbelow, carriage 40 traverses receiver 20 so as to carry print head 30 in a direction parallel with respect to marginal edge 25. Carriage 40 includes a first bore 42 therethrough lined with internal threads (not shown) and further includes a smooth second bore 45, for reasons disclosed hereinbelow.

Referring again to FIGS. 1, 2 and 3, radiation detector, such as a photodiode or photodetector 50 is attached to carriage 40 for detecting high frequency modulated image forming data carried by a light beam 60, which may be an infrared light beam. Light beam 60 actuates print head 30 in response to the image forming data detected by photodetector 50, as described more fully hereinbelow. The image forming data carried by light beam 60 is data describing the image to be printed on receiver 20. In this regard, infrared light beam 60 comprises high frequency wavelengths greater than the wavelengths (i.e., approximately 700 nanometers) of the deepest reds of the visible spectrum but less than the wavelengths (i.e., approximately 100,000 nanometers and greater) of microwaves. A radiation source, such as an infrared light source 70 is in optical communication or optically linked with photodetector 50 for emitting light beam 60 substantially along a predetermined optical axis 65 such that light beam 60 is received by photodetector 50.

Still referring to FIGS. 1, 2 and 3, a controller, which may be a suitable computer 80, is electrically connected to carriage 40, such as by means of a flexible electrical conducting cable 90. Cable 90 has either fewer electrical conductors therein or the same number of conductors but of greater capacity than prior art devices. At least one of the electrical conductors 92 is attached to earth ground as at location 95. The purpose of computer 80 is to control the overall operation of printer apparatus 10. This is accomplished by sending power and low frequency electric signals to carriage 40 via flexible electrical conducting cable 90 while sending high frequency image forming data to print head 30 via the aforementioned infrared optical data link. Thus, cable 90 functions as an electrical signal transfer path interconnecting computer 80 and carriage 40 for transferring the low frequency electrical signals therebetween. Actuation of motors 120 and 150 is also controlled by computer 80 as will be described.

Referring yet again to FIGS. 1, 2 and 3, a support member or platen 100 is disposed near print head 30 for supporting receiver 20 at a location adjacent receiver 20. Platen 100 supports print head 30 in a manner such that receiver 20 is interposed between print head 30 and platen 100 and such that receiver 20 drapes platen 100, as shown. In this regard, platen 100 and print head 30 define a gap or nip 105 therebetween of predetermined width for accommodating receiver 20 as receiver 20 traverses through nip 105, as described more fully hereinbelow. In addition, positioned adjacent platen 100 and anteriorly of print head 30 is a receiver translation mechanism or elongate receiver nip roller 107 which is disposed parallel to marginal edge 25. Nip roller 107 engages receiver 20 for biasing receiver 20 against platen 100 as receiver 20 traverses through nip 105. Moreover, also disposed adjacent platen 100 is a translation member, such as a rotatable roller 110. Roller 110 is capable of intimately engaging receiver 20 for translating receiver 20 through nip 105. More specifically, a reversible first motor 120 engages an end portion of roller 110, such as by means of an axle 125, for rotating roller 110, so that receiver 20 translates through nip 105 as first motor 120 rotates roller 110. First motor 120 is reversible for either advancing or retracting receiver 20 through nip 105. In addition, a rotatable lead screw 130 disposed parallel to marginal edge 25 has exterior threads 140 thereon for threadably engaging the interior threads (not shown) lining first bore 42, which is cut through carriage 40. A reversible second motor 150 engages an end portion of lead screw 130, such as by means of a second axle 160, for rotating lead screw 130, so that carriage 40 translates along lead screw 130 as lead screw 140 rotates.

Second motor 150 is reversible for reciprocatingly translating carriage 40 along lead screw 140 as lead screw 140 rotates in either a clock-wise or counter clock-wise direction. In this manner carriage 40, and thus print head 30 attached thereto, translates parallel to marginal edge 25 of receiver 20. Carriage 40 is itself slidably supported by a smooth, elongated support rod 170 disposed parallel to marginal edge 25 and which matingly extends through smooth second bore 45 that is cut through carriage 40. Thus, carriage 40 slides along support rod 170 and is supported thereby as carriage 40 translates parallel to marginal edge 25.

As shown in FIGS. 1, 2 and 3, light source 70 emits infrared light beam 60, which contains the previously mentioned image forming data. This image forming data is encoded as serial data pulses or bits before being transmitted. In the case of a printer either exposing pixels with a fixed level, or not exposing a pixel at all (i.e., a bi-level printer), the data bits represent sequential pixels to be printed. These bits are of course synchronized with the translation speed of print head 30. As is well known in the art, it is possible to take parallel data words of 8 bits, 16 bits, or in fact any desired width and convert them to a serial bit stream by the use of a parallel to serial shift register. These data bits are then encoded into one of many "self clocking codes". By the addition of synchronizing pulses this data can be decoded at print head 30. One method of creating these synchronizing pulses is to transmit them at an easily discernible higher optical power level, for example twice the power level of the serial data bits. Each of these "sync" pulses indicates the beginning of another fixed width data word. By the use of a serial to parallel shift register located on carriage 40 the original parallel data word may be restored. This parallel data word may then feed a parallel input digital to an analog converter (not shown) which can drive the exposing LEDs to one of many levels (1 out of 256 in the case of an 8 bit data word). Many other methods for transmitting this serial bit data stream are known in the art. For example, such methods are disclosed in "IrDA Data Link Design Guide" published by the Hewlett Packard Company, located in Palo Alto, Calif. This publication summarizes standards, promulgated by the IrDA (Infrared Data Association), for interoperable infrared data transmission systems.

Returning to FIGS. 1, 2 and 3, light source 70 converts the serial electrical pulses into infrared light pulses. Light source 70 preferably uses a high speed, high efficiency AlGaAs light emitting diode, together with a high speed drive circuit (not shown) to produce high power infrared light pulses with minimal pulse width distortion. Light beam 60 itself has an intensity between a minimum and a maximum everywhere within a cone with a half angle of approximately 15° degrees off optical axis 65 along which light beam 60 travels.

As shown in FIGS. 1, 2 and 3, detector 50 is coupled to an electronic circuitry 180 which demodulates or decodes the image forming data received by photodetector 50. Electronic circuitry 180 preferably allows transfer of the image forming data at distances from zero to at least one meter, even in the presence of ambient electrical and optical noise. The image forming data detected by photodetector 50 is converted into electrical pulses by electronic circuitry 180. Electronic circuitry 180 may include an amplifier 190 to achieve maximum sensitivity for low power signals (e.g., 4 $\mu$W/cm$^2$) and to limit pulse width distortion for high power signals (e.g., 500 mW/cm2). A photodetector and infrared light source suitable for this purpose may be of the type found in the "HSDL-1001" system available from Hewlett-Packard Company, located in Palo Alto, Calif.

Referring again to FIGS. 1, 2 and 3, previously mentioned photodetector 50 receives light beam 60 carrying the modulated or encoded image forming data therein. Photodetector 50 recognizes light radiation between a predetermined minimum irradiance and a predetermined maximum irradiance (e.g., maximum irradiance of 500 mW/cm$^2$). Moreover, photodetector 50 is capable of rejecting ambient optical noise. For example, detector 50 may be selected so that it is capable of rejecting 10 kilolux of sunlight, 1000 lux of fluorescent light and 1000 lux of incandescent light.

However, it is known that electromagnetic radiation and power supply noise are generated by electronic circuitry, such as electronic circuitry 180, and controllers, such as computer 80. Such power supply noise can intrude into circuitry 180 and photodetector 50 through signal and ground lines and thereby radiate into the free space surrounding printer apparatus 10. A common approach to resolving this problem is to totally enclose such an electromagnetic radiation source (e.g., printer apparatus 10) within an electromagnetically non-conductive containment (e.g., a steel box) so that the electromagnetic radiation field strength is at or less than a predetermined threshold level specified by Governmental regulations administered by the Federal Communications Commission. However, placement of the electromagnetic radiation source (e.g., electronic circuitry 180 or computer 80) within a single containment is both costly and results in a larger machine. In addition, other electronic devices (not shown) possessing electronic circuits therein may be present in the vicinity of printer apparatus 10. Electromagnetic radiation emitting from these other devices may interfere with proper operation of printer apparatus 10. Therefore, for the foregoing reasons, it is desirable to shield photodetector 50, electronic circuitry 180 and computer 80 from interfering electromagnetic radiation.

Therefore, as best seen in FIGS. 2 and 3, a first shielding enclosure 200 substantially surrounds computer 80 and confine a first electromagnetic radiation field emitting from computer 80. In the preferred embodiment of the invention, an opening (not shown) in enclosure 200 allows infrared light beam 60 to pass therethrough. This opening can be sized (e.g. on the order of 0.125" internal diameter, or less) to function optically while still exhibiting a high impedance to electromagnetic waves. If necessary, optically transparent, but electrically conductive windows may be installed in enclosure 200 for this purpose. In addition, first shielding enclosure 200 may be formed of any suitable material for blocking electromagnetic radiation, such as steel. Moreover, a second shielding enclosure 210 substantially surrounds carriage 30, including photodetector 50 attached thereto, for containing a second electromagnetic radiation field emitting from electronic circuitry 180. In this regard, second shielding enclosure 210 may be formed of any suitable material for blocking electromagnetic radiation, such as steel. Of course, second enclosure 210 has an aperture (not shown) for allowing light beam 60 to enter thereinto. The aperture is transparent to light beam 60 but opaque to electromagnetic radiation. This opening can be sized (e.g. on the order of 0.125" internal diameter, or less) to function optically while still exhibiting a high impedance to electromagnetic waves. If necessary, optically transparent, but electrically conductive windows may be installed in enclosure 200 for this purpose.

It will be understood from the teachings herein that an advantage of the present invention is the elimination of a cable for electrically transmitting high frequency image forming data to print head 30 by use of the infrared data link disclosed herein. In addition, the shielding enclosures 200 and 210 confine electromagnetic radiation to computer 80 and carriage 40. In addition, the infrared light energy traveling between light source 70 and photodetector 50 does not interfere with operation of nearby electronic devices because the wavelength of the light energy will not penetrate normal device enclosures (e.g. plastic, or metal cabinets), also this light energy is narrowly focused substantially along optical axis 65.

The invention has been described in detail with particular reference to certain preferred embodiments thereof, but it will be understood that variations and modifications can be effected within the spirit and scope of the invention. For example, light beam 60 may comprise light in the visible spectrum rather than infrared light. As another example, multiple optical wavelengths may be used rather a single infrared wavelength. As still another example, optical axis 65 may be replaced with an optical fiber having a suitable low energy loss rate. As yet another example, multiple light emitter-detector pairs may be used rather than a single light source 70 and a single photodetector 50. In addition, cable 90 may be provided with shielding to shield against electromagnetic radiation emitting therefrom. Moreover, it may be appreciated from the teachings herein that any technique to transmit high frequency data to a movable print head and/or carriage for easing compliance with international electromagnetic radiation (i.e. radio frequency or microwave frequency) standards, such as the standards promulgated by the previously mentioned Infrared Data Association, are also anticipated by the present invention.

Therefore, what is provided is a printing apparatus and method including an electromagnetic interference reducing optical data link for transmitting image forming data.

PARTS LIST

10 . . . printer apparatus
20 . . . receiver
25 . . . marginal edge (of receiver 20)
30 . . . print head
40 . . . carriage
42 . . . first bore
45 . . . second bore
50 . . . photodetector
60 . . . light beam
70 . . . light source
80 . . . computer
90 . . . flexible cable
92 . . . conductor
95 . . . location of connection to earth ground
100 . . . platen
105 . . . nip
107 . . . receiver nip roller
110 . . . roller
120 . . . first motor
125 . . . first axle
130 . . . lead screw
140 . . . exterior threads
150 . . . second motor
160 . . . second axle
170 . . . support rod
180 . . . electronic circuitry
190 . . . amplifier
200 . . . first shielding enclosure
210 . . . second shielding enclosure

What is claimed is:

1. A printer apparatus for printing on a receiver member moving in a first direction comprising:

a carriage support for supporting a carriage for lateral movement in a second direction perpendicular to the first direction;

a carriage which is supported on the carriage support and which moves bi-directionally along a carriage path thereon;

a print head mounted on the carriage for bi-directional movement with the carriage;

electronic circuitry mounted on the carriage for bi-directional movement with the carriage;

an optical data link for providing to the print head first control signals, the optical data link including an optical data transmitter, the optical data transmitter being mounted in a first housing that includes a controller for generating the first signals which are of relatively high frequency, the optical data link including an optical data receiver mounted in a second housing, the second housing being mounted on the carriage for bidirectional movement relative to the first housing;

a flexible electrical connector that extends substantially between and electrically connects the controller to the electronic circuitry for providing power signals to the print head;

the first housing including a first enclosure for substantially shielding the controller from external interfering electromagnetic fields; and the second housing including a second enclosure for substantially shielding the optical data receiver and the electronic circuitry from external interfering electromagnetic fields.

2. The printer apparatus of claim 1 wherein the first housing includes an opening that allows a light beam emitted by the optical data transmitter to pass therethrough.

3. The printer apparatus of claim 2 wherein the opening is of the order of 0.125 inches internal diameter or less.

4. The printer apparatus of claim 2 wherein said print head is an ink jet print head.

5. The printer apparatus of claim 1 wherein the first housing includes an optically transparent but electrically conductive window for providing a shield to external electromagnetic radiation but allowing light emitted by the optical data transmitter to pass therethrough.

6. The printer apparatus of claim 1 wherein said print head is an ink jet print head.

7. The printer apparatus of claim 1 wherein the carriage support comprises a rotatable lead screw that threadably engages interior threads of a bore in the carriage.

8. A method for operating a printer comprising:

moving a carriage on a carriage support bidirectionally along a carriage path that is perpendicular to movement of a receiver member upon which an image is to be printed, the carriage including electronic circuitry and a print head that is responsive to high frequency first signals and power signals, the electronic circuitry and the print head moving bi-directionally with the carriage;

operating a controller to generate the high frequency first signals;

transmitting the high frequency first signals through an optical data link wherein an optical transmitter is mounted in a first housing that includes the controller for generating the first signals;

receiving the high frequency first signals by an optical data receiver mounted in a second housing, the second housing being mounted on the carriage for bi-directional movement relative to the first housing;

transmitting the power signals through a flexible electrical connector that substantially extends between and connects the controller to the electronic circuitry for providing power to the print head;

shielding the controller from external interfering electromagnetic fields; and shielding the optical data receiver and the electronic circuitry from external interfering electromagnetic fields.

9. The method of claim 8 wherein the first housing includes an opening that allows a light beam emitted by the optical data transmitter to pass therethrough.

10. The method of claim 9 wherein the opening is of the order of 0.125 inches internal diameter or less.

11. The method of claim 8 when the first ho using includes an optically transparent but electrically conductive window for providing a shield to external electromagnetic radiation but allowing light emitted by the optical data transmitter to pass therethrough.

12. The method of claim 8 wherein the print head is an ink jet print head that emits ink to record on the receiver member.

13. The method of claim 8 wherein a lead screw rotates in a threaded coupling with the carriage to move the carriage.

* * * * *